US005642827A

United States Patent [19]

Madsen

[11] Patent Number: 5,642,827

[45] Date of Patent: Jul. 1, 1997

[54] REFRIGERATED CONTAINER AND A GABLE FRAME

[75] Inventor: Kurt Bo Madsen, TØnder, Denmark

[73] Assignee: Maersk Container Industri AS, Tinglev, Denmark

[21] Appl. No.: 649,725

[22] PCT Filed: Dec. 1, 1994

[86] PCT No.: PCT/DK94/00447

§ 371 Date: Aug. 12, 1996

§ 102(e) Date: Aug. 12, 1996

[87] PCT Pub. No.: WO95/15288

PCT Pub. Date: Jun. 8, 1995

[30] Foreign Application Priority Data

Dec. 2, 1993 [DK] Denmark ..... 1348/93

[51] Int. Cl.[6] ..... B65D 33/04

[52] U.S. Cl. ..... 220/1.5; 296/191; 220/4.28; 220/421; 220/444

[58] Field of Search ..... 220/1.5, 421, 420, 220/444, 902, 468, 4.28; 296/191, 190, 181

[56] References Cited

U.S. PATENT DOCUMENTS

| | | | |
|---|---|---|---|
| 4,726,486 | 2/1988 | Masuda | 220/1.5 |
| 4,795,047 | 1/1989 | Dunwoudie | 220/1.5 |
| 4,802,600 | 2/1989 | Bretschneider et al. | 220/1.5 |
| 4,836,395 | 6/1989 | Goutille | 220/1.5 |
| 5,535,907 | 7/1996 | Elvin-Jensen | 220/1.5 |

FOREIGN PATENT DOCUMENTS

| | | |
|---|---|---|
| 467107 | 3/1991 | Denmark . |
| 2939887 | 6/1986 | Germany . |

*Primary Examiner*—Joseph M. Moy
*Attorney, Agent, or Firm*—Ladas & Parry

[57] ABSTRACT

A double-walled refrigerated container (1) having an inner cladding (2) and an outer cladding (3) comprising horizontal and vertical sheet members (6, 7, 8; 9, 10, 11) to form the internal and external, respectively, wall, roof and bottom faces of the claddings and an intermediate, bonded insulation layer (4) of plastics foam, said sheet members (9, 10, 11) of the outer cladding (3) being attached to the load receiving frame of the container (1), which comprises upper and lower longitudinal girders (12, 13) and upper and lower transverse girders (14, 15) and vertical corner posts (16) at the gables. The interconnected upper and lower transverse girders (14, 15) and vertical corner posts (16) provide an outer gable frame (14, 15, 16) with which the sheet members (9, 10, 11) of the outer cladding are connected. An inner gable frame (19*a, b, c*) of sheet material with which the sheet members (6, 7, 8) of the inner cladding are connected and an intermediate, annular and bonded insert (20) of an elastically resilient material between the outer and inner gable frames.

7 Claims, 4 Drawing Sheets

REFRIGERATED CONTAINER AND A GABLE FRAME

Figure 1:
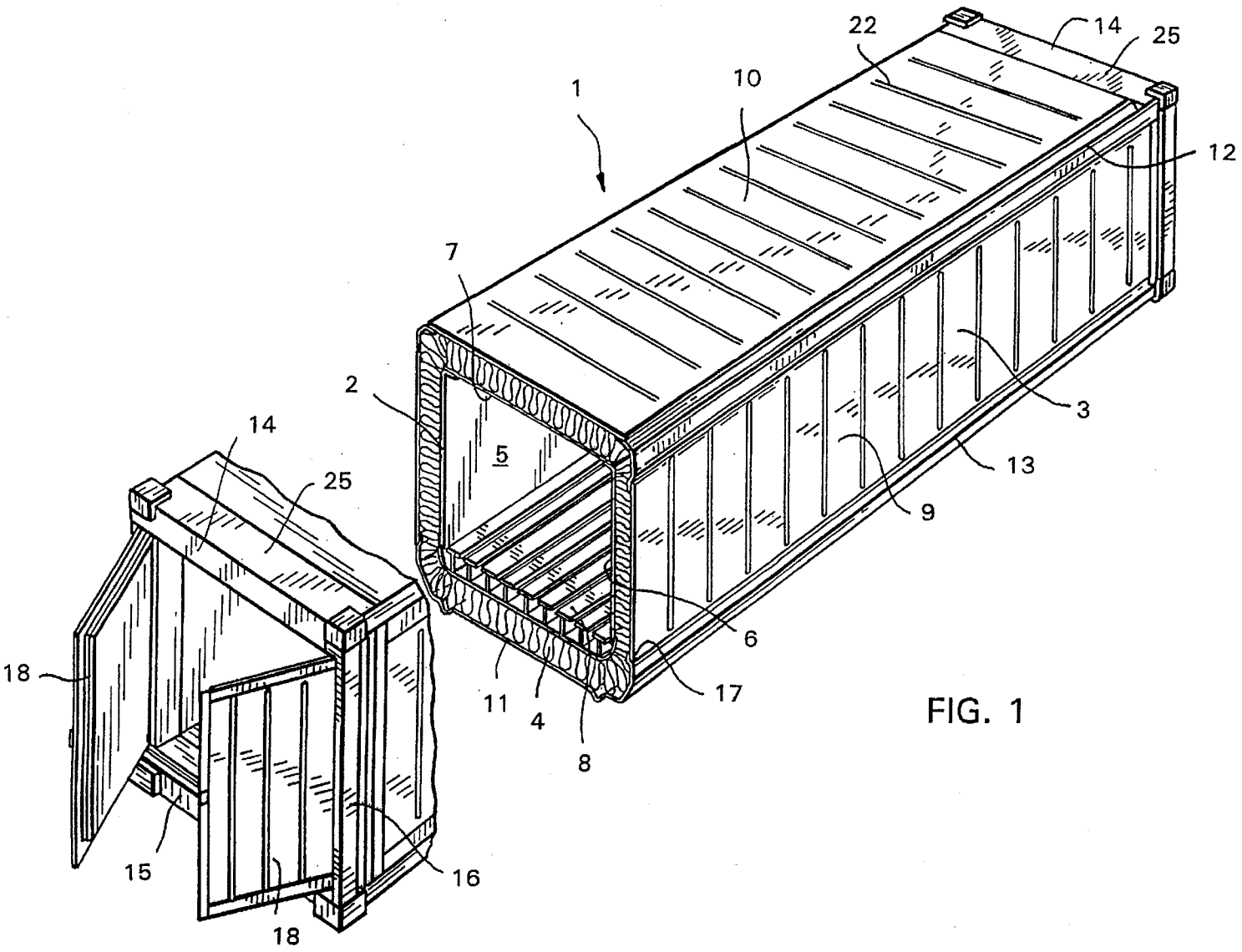

The present invention concerns a double-walled refrigerated container having an inner cladding and an outer cladding comprising horizontal and vertical, substantially plane sheet members to form the internal and external, respectively, wall, roof and bottom faces of the claddings as well as an intermediate, bonded insulation layer of plastics foam, said sheet members of the outer cladding being attached to the load receiving frame of the container, which comprises upper and lower longitudinal girders as well as upper and lower transverse girders and vertical corner posts at the gables.

Today refrigerated containers of the type mentioned above are widely used for oversea transportation of food products which must be kept cooled at temperatures within very narrow temperature ranges depending upon the nature of the transported goods. Therefore, strict requirements are made with respect to the tightness and the insulation capacity of the container during use for an extended period of time. The refrigerated containers are thus to maintain a predetermined inner temperature everywhere in their interior under the action from surroundings with strongly fluctuating temperature and moisture conditions and preferably also with a limited consumption of energy. These are factors which are of decisive importance for the transport earning capacity when using the refrigerated container in question.

It is therefore extremely important that there is only a small number of thermal bridges in the insulation layer of the refrigerated container structure, and that the areas which are relatively heat-conductive are limited to the greatest extent possible. In the refrigerated container mentioned above thermal bridges occur in particular at the gables where the outer cladding and the inner cladding of the container are Joined. Because of the great mechanical stresses which the inner and outer claddings of a refrigerated container are to absorb and transfer to the frame, the outer cladding is frequently made of steel sheet material and the inner cladding of both steel and aluminium sheet material. Both of these materials are strong heat conductors with respect to the intermediate insulation materials. It is also necessary to separate the steel outer cladding and the aluminium inner cladding from each other to prevent galvanically caused corrosion and direct heat transmission from the outer cladding to the inner cladding.

In the initially mentioned, known refrigerated containers these transitions between the outer cladding and the inner cladding are frequently made of plastics profiles which are glued and/or riveted to the outer cladding and the inner cladding of the refrigerated container. It is known by experience that the transitions rapidly become leaky when the refrigerated container has been used for some time. Leakages in these transitions result in an undesirable strong reduction in the insulation capacity and the rigidity of the refrigerated container. Thus, water vapour can diffuse into the insulation, and the insulation material releases part of its content of the insulating special gas to the atmosphere. Water penetration into the insulation moreover initiates chemical as well as mechanical degradation processes, and in particular involves the risk of ice formation in the insulation face, which causes the refrigerated container to be destroyed.

The double-walled refrigerated container of the present invention is characterized in that the interconnected upper and lower transverse girders and vertical corner posts provide an outer gable frame with which the sheet members of the outer cladding are connected, and that it includes an inner gable frame of sheet material with which the sheet members of the inner cladding are connected as well as an intermediate, annular and bonded insert of an elastically resilient material between the outer and inner gable frames. This structure provides a refrigerated container which will be tight also after an extended period of use, so as to ensure a permanent optimum insulation capacity.

The inner cladding and the outer cladding can thus "work" slightly with respect to each other, and the formation of undesirable thermal bridges at the joint of the claddings at the gables is obviated. The intermediate insert of the resilient, rubber-like material is thus both galvanically and thermally insulating between the inner and outer claddings. Further, as mentioned, the insert can transfer mechanical stresses between claddings and is also water vapour diffusion-tight and water-repellant.

The invention moreover concerns a gable frame for use in a double-walled refrigerated container of the type mentioned in the opening paragraph, characterized in that the gable frame is composed of an outer frame comprising the interconnected upper and lower transverse girders and vertical corner posts and an inner frame of sheet material as well as an intermediate, annular and bonded insert of an elastically resilient material between the outer and inner frames. This structure provides a gable frame which involves the same operational advantages for the refrigerated container as mentioned above. The gable frame may be mounted at both ends of the container, i.e. both at the end provided with doors and the end in which a refrigerating unit is usually introduced, said refrigerating unit being subsequently sealed along the periphery of the frame. Assembly of the gable frames of the invention to a preassembled unit comprising the welded inner cladding and outercladding as well as the intermediate, foamed insulation layer of the refrigerated container, provides a particularly rapid completion of a refrigerated container. In this assembly of the gable frame, the outer frame with the outer cladding and the inner frame with the inner cladding are welded together.

Figure 2:
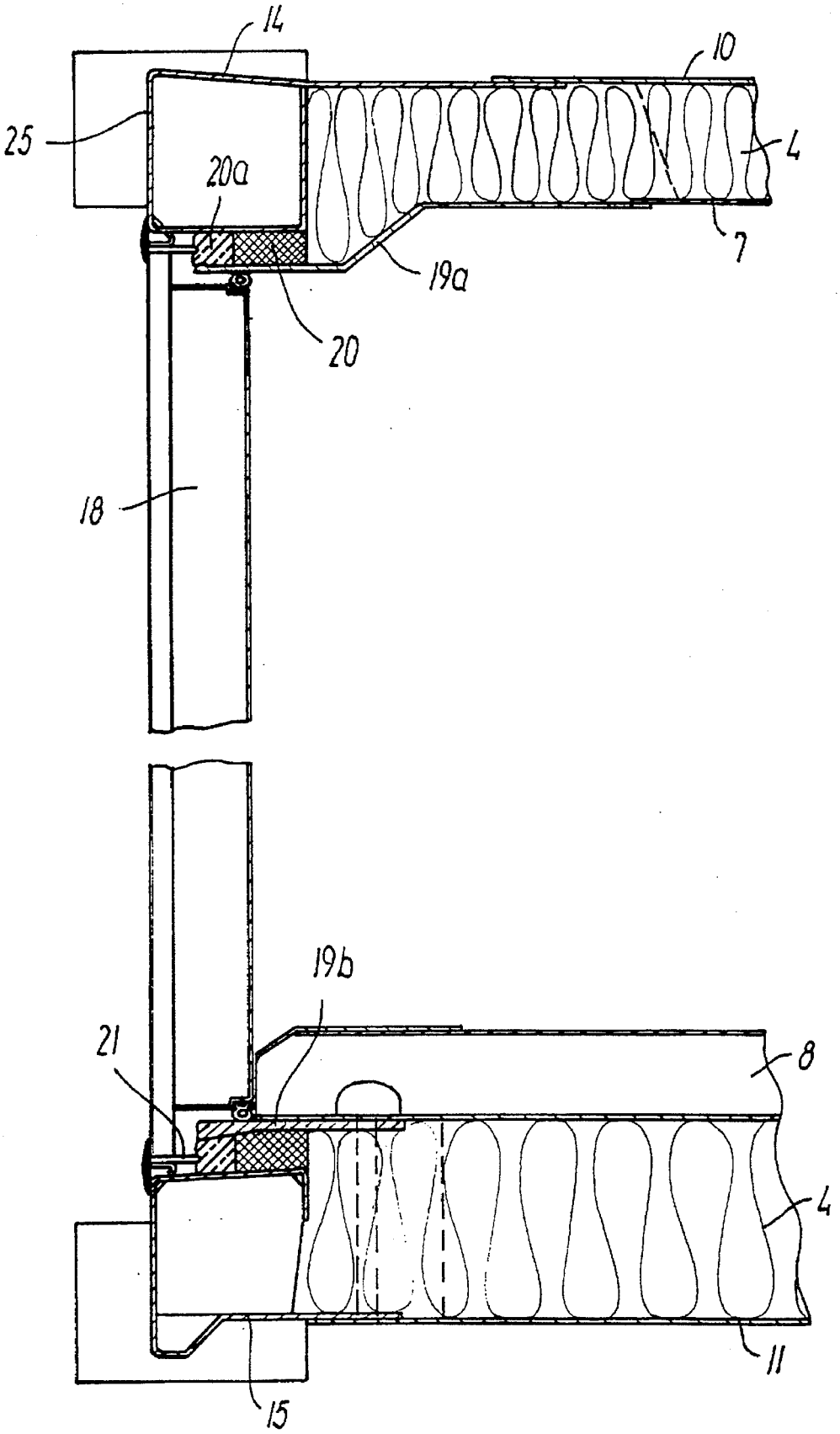
Figure 3:
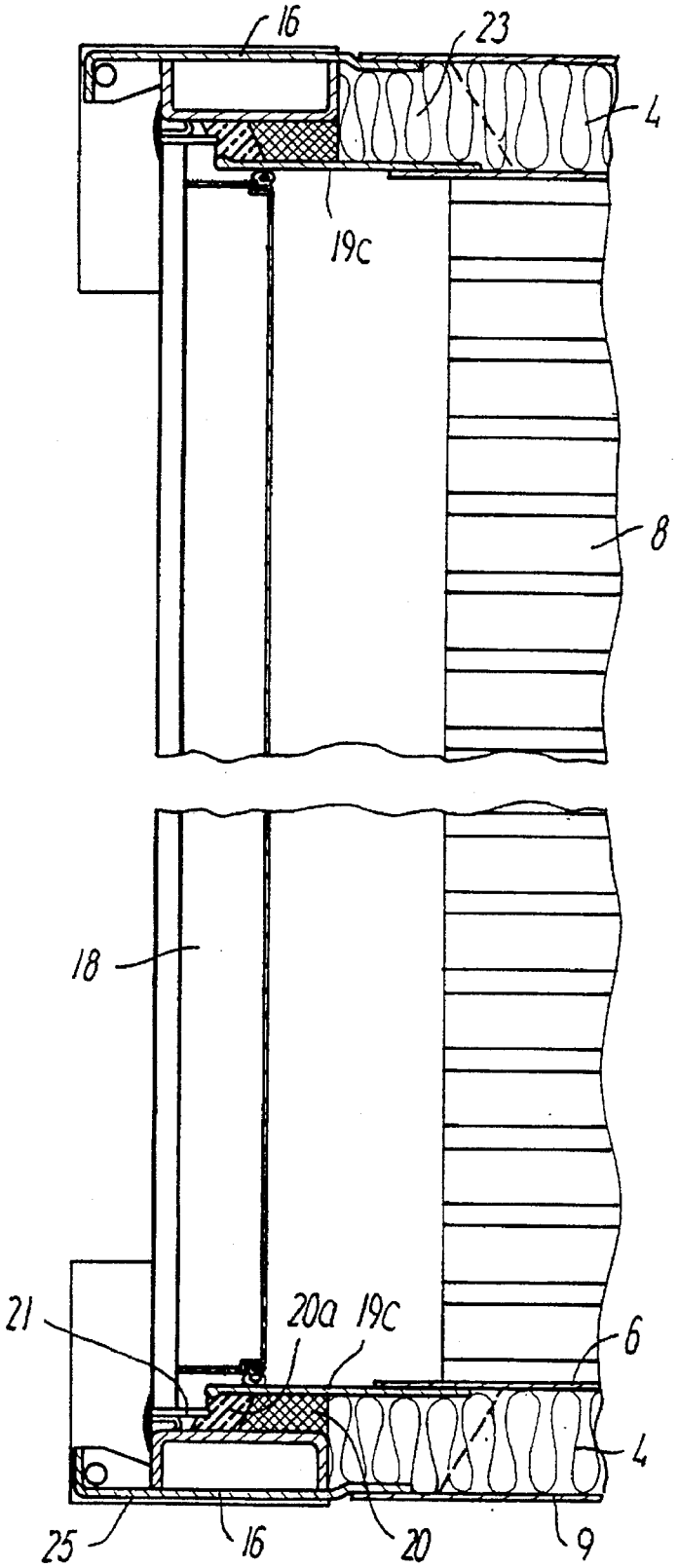
Figure 4:
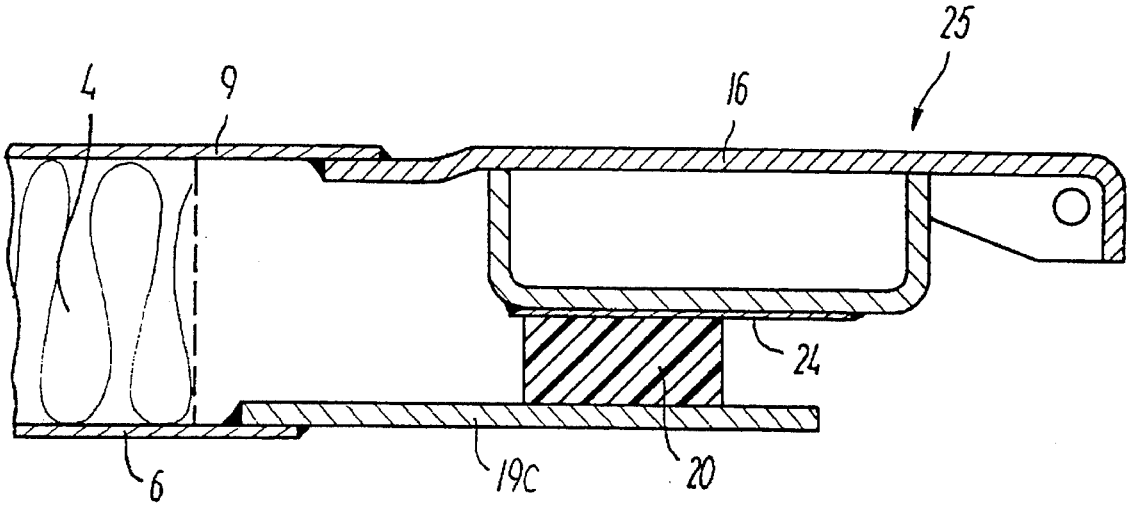

The invention will be explained more fully below with reference to the drawing, in which, FIG. 1 is a partially sectional view of the refrigerated container of the invention, but on a somewhat incorrectly drawn scale to show the annular insulation layer more clearly, FIG. 2 is an enlarged vertical sectional view through the gable frame which comprises the container doors, FIG. 3 is a horizontal section through the same, and FIG. 4 is an enlarged horizontal section through a particularly expedient embodiment of the gable frame of the invention.

The double-walled refrigerated container 1 shown in FIG. 1 comprises an inner cladding 2 of an aluminium sheet material and an outer cladding 3 of a steel sheet material 9, 10, 11. The refrigerated container 1 moreover comprises an intermediate, bonded insulation layer 4 of polyurethane foam.

The inner cladding 2 comprises vertical sheet members 5, 6, which form the internal wall faces of the inner cladding, as well as horizontal sheet members 7, which form the internal roof faces. The inner cladding 2 moreover comprises a T-floor 8 of extruded aluminium profiles welded together. All Joints between the sheet members 5, 6, 7 of the inner cladding and the T-floor 8 are all-welded to provide a completely diffusion-tight, strong and rigid inner shell.

The outer cladding 3 comprises substantially plane sheet members 9, 10 and 11 of a stainless steel sheet material to form the external wall, roof and bottom faces.

The sheet members 9, 10 and 11 of the outer cladding 3 are welded to upper and lower longitudinal girders 12, 13 which are made of bent sheet material in the shown embodiment. The refrigerated container 1 comprises a load receiving frame which comprises said upper and lower longitudinal girders 12, 13 welded to gable frames 25 at the gables.

The gable frames 25 comprise an outer frame of upper and lower transverse girders 14, 15, which are welded together, and vertical corner posts 16, which are welded to said longitudinal girders 12, 13 to provide the load receiving frame of the container. The gable frame moreover comprises an inner frame 19*a, b, c* of sheet material as well as an intermediate, annular and bonded insert 20 of an elastically resilient material between the outer and inner frames. The insert 20 is preferably formed by a moulded polyurethane plastics material, but may also be formed by moulded rubber, see FIGS. 2 and 3.

The external frame of the gable frame 25, which is formed by the interconnected upper and lower transverse girders 14, 15 and vertical corner posts 16, is welded to the outer cladding 9, 10, 11 of the container. Further, the interior sheet material frame 19*a, b, c* of the gable frame 25 is welded to the inner cladding 6, 7, 8 of the refrigerated container. Then the remaining annular cavity 23 is foamed to provide the termination of the insulation layer 4 against the members of the gable frame 25.

This ensures that the inner cladding and the outer cladding can work sligthly with respect to each other, without involving any risk of leakages that might cause detrimental water vapour diffusion into the insulation, or diffusion of cell gases away from the insulation of the container that might reduce the insulation capacity. Further, galvanic corrosion is avoided, which may occur at a metalic connection between inner cladding and outer cladding.

The container doors 18 may be provided with an annular, inwardly extending knife or engagement strip 21, which is pressed into a further intermediate insert 20*a* of rubber or directly into the resilient insert 20 upon closure of the doors 18. This ensures particularly reliable sealing of the doors 18.

Prior to the moulding of the insert 20, "sacrificial sheet members" 24 may be welded to the inwardly directed side of the outer frame 14, 15, 16, as shown by the expedient embodiment in FIG. 4. Then the intermediate insert 20 of rubber is moulded on the sacrificial sheet members 24. The sacrificial sheet members 24 preferably consist of the same material as the external cladding of the container or of a metal which is less noble.

Many modifications can be made within the scope of the invention. The inner and outer frames of a gable frame 25 may be made of many different sheet material types as well as of profiles.

I claim:

1. A double-walled refrigerated container (1) having an inner cladding (2) and an outer cladding (3) comprising horizontal and vertical sheet members (6, 7, 8; 9, 10, 11) to form the internal and external, respectively, wall, roof and bottom faces of the claddings as well as an intermediate, bonded insulation layer (4) of plastics foam, said sheet members (9, 10, 11) of the outer cladding (3) being attached to the load receiving frame of the container (1), which comprises upper and lower longitudinal girders (12, 13) as well as upper and lower transverse girders (14, 15) and vertical corner posts (16) at the gables, characterized in that the interconnected upper and lower transverse girders (14, 15) and vertical corner posts (16) provide an outer gable frame (14, 15, 16) with which the sheet members (9, 10, 11) of the outer cladding are connected, and that it includes an inner gable frame (19*a, b, c*) of sheet material with which the sheet members (6, 7, 8) of the inner cladding are connected as well as an intermediate, annular and bonded insert (20) of an elastically resilient material between the outer and inner gable frames.

2. A double-walled refrigerated container according to claim 1, characterized in that the intermediate insert (20) of a resilient material is formed by a moulded plastics material.

3. A double-walled refrigerated container according to claim 1, characterized in that the sheet members (6, 7, 8) and (9, 10, 11) of the inner cladding (2) and the outer cladding (3), respectively, are connected with the inner gable frame (19*a, b, c*) and the outer gable frame (14, 15, 16), respectively, by welding.

4. A gable frame (25) for use in a double-walled refrigerated container (1) comprising an inner cladding (2) and an outer cladding (3) of horizontal and vertical sheet members (6, 7, 8; 9, 10, 11) to form the internal and external, respectively, wall, roof and bottom faces of the claddings as well as an intermediate, bonded insulation layer (4) of plastics foam, said sheet members (9, 10, 11) of the outer cladding being attached to the load receiving frame of the container (1), which, in the mounted state, comprises upper and lower longitudinal girders (12, 13) as well as upper and lower transverse girders (14, 15) and vertical corner posts (16) at the gables, characterized in that the gable frame (25) is composed of an outer frame comprising the upper and lower transverse girders (14, 15) and vertical corner posts (16), and an inner frame of sheet members (19*a, b, c*) as well as an intermediate, annular and bonded insert (20) of an elastically resilient material between the outer and inner frames.

5. A gable frame according to claim 4, characterized in that the intermediate insert (20) of a resilient material is formed by a moulded polyurethane plastics material.

6. A gable frame according to claim 4, characterized in that the gable frame comprises an additional, annular and outwardly directed insert (20*a*) of a resilient sealing material into which annular engagement strips (20) on the container doors (18) extend in the closed state.

7. A gable frame according to claim 4, characterized in that the gable frame comprises a sacrificial sheet material mounted directly on the outer and/or the inner frame.

* * * * *